US008828221B2

(12) United States Patent
Gordon

(10) Patent No.: US 8,828,221 B2
(45) Date of Patent: Sep. 9, 2014

(54) UPGRADING PLATFORM USING ALKALI METALS

(75) Inventor: John Howard Gordon, Salt Lake City, UT (US)

(73) Assignee: Ceramatec, Inc., Salt Lake City, UT (US)

( * ) Notice: Subject to any disclaimer, the term of this patent is extended or adjusted under 35 U.S.C. 154(b) by 0 days.

(21) Appl. No.: 13/550,313

(22) Filed: Jul. 16, 2012

(65) Prior Publication Data

US 2013/0043160 A1 Feb. 21, 2013

Related U.S. Application Data

(63) Continuation-in-part of application No. 12/916,984, filed on Nov. 1, 2010.

(60) Provisional application No. 61/257,369, filed on Nov. 2, 2009, provisional application No. 61/508,415, filed on Jul. 15, 2011.

(51) Int. Cl.

| | |
|---|---|
| ***C10G 17/00*** | (2006.01) |
| ***C10G 29/20*** | (2006.01) |
| ***C10G 50/00*** | (2006.01) |
| ***C10G 29/04*** | (2006.01) |

(52) U.S. Cl.

CPC ..... *C10G 29/04* (2013.01); *C10G 2300/308* (2013.01); *C10G 29/20* (2013.01); *C10G 2300/1037* (2013.01); *C10G 2300/207* (2013.01); *C10G 2300/202* (2013.01); *C10G 2300/205* (2013.01); *C10G 2300/1025* (2013.01); *C10G 50/00* (2013.01)

USPC ..... 208/177

(58) Field of Classification Search

USPC ..... 208/97, 208 M, 226, 284, 287

See application file for complete search history.

(56) References Cited

U.S. PATENT DOCUMENTS

| | | | |
|---|---|---|---|
| 1,501,756 | A | 7/1924 | Downs |
| 2,836,633 | A | 5/1958 | Esmay |
| 3,497,569 | A | 2/1970 | Stiles et al. |
| 3,785,965 | A | 1/1974 | Welty |
| 3,787,315 | A | 1/1974 | Bearden, Jr. et al. |

(Continued)

FOREIGN PATENT DOCUMENTS

| | | |
|---|---|---|
| WO | WO-02099013 | 12/2002 |
| WO | WO-2010124030 | 10/2010 |
| WO | WO-2011012900 | 2/2011 |

OTHER PUBLICATIONS

Lee, Dong W., "International Search Report", PCT/US2013/023850 (Corresponding to U.S. Appl. No. 13/753,918), (May 14, 2013), 1-3.

(Continued)

*Primary Examiner* — Randy Boyer
*Assistant Examiner* — Juan Valencia
(74) *Attorney, Agent, or Firm* — David Fonda

(57) ABSTRACT

A process for removing sulfur, nitrogen or metals from an oil feedstock (such as heavy oil, bitumen, shale oil, etc.) The method involves reacting the oil feedstock with an alkali metal and a radical capping substance. The alkali metal reacts with the metal, sulfur or nitrogen content to form one or more inorganic products and the radical capping substance reacts with the carbon and hydrogen content to form a hydrocarbon phase. The inorganic products may then be separated out from the hydrocarbon phase.

11 Claims, 8 Drawing Sheets

(56) References Cited

U.S. PATENT DOCUMENTS

| | | | | |
|---|---|---|---|---|
| 3,788,978 | A | 1/1974 | Bearden, Jr. et al. | |
| 3,791,966 | A | 2/1974 | Bearden | |
| 3,960,708 | A | 6/1976 | McCollum et al. | |
| 4,076,613 | A | 2/1978 | Bearden, Jr. | |
| 4,428,828 | A | 1/1984 | Bose | |
| 5,328,577 | A * | 7/1994 | Murphy | 204/168 |
| 5,695,632 | A | 12/1997 | Brons et al. | |
| 5,750,814 | A | 5/1998 | Grootjans et al. | |
| 5,935,419 | A | 8/1999 | Khan et al. | |
| 5,935,421 | A | 8/1999 | Brons et al. | |
| 6,210,564 | B1 | 4/2001 | Brons et al. | |
| 6,280,128 | B1 | 8/2001 | Schrader | |
| 6,368,486 | B1 | 4/2002 | Thompson et al. | |
| 6,413,898 | B1 | 7/2002 | Faber et al. | |
| 6,635,795 | B2 | 10/2003 | Gislason et al. | |
| 6,706,902 | B2 | 3/2004 | Stumann et al. | |
| 6,734,133 | B1 | 5/2004 | Weisbeck et al. | |
| 6,787,019 | B2 | 9/2004 | Jacobson et al. | |
| 7,897,028 | B2 | 3/2011 | Gordon et al. | |
| 8,088,270 | B2 | 1/2012 | Gordon et al. | |
| 2002/0125175 | A1 | 9/2002 | Collins et al. | |
| 2005/0145545 | A1 * | 7/2005 | Schucker | 208/208 M |
| 2005/0161340 | A1 | 7/2005 | Gordon et al. | |
| 2006/0054538 | A1 | 3/2006 | Hsu et al. | |
| 2006/0138029 | A1 | 6/2006 | Malek et al. | |
| 2007/0087934 | A1 | 4/2007 | Martens et al. | |
| 2008/0031792 | A1 * | 2/2008 | Ciccarelli et al. | 423/225 |
| 2009/0134040 | A1 | 5/2009 | Gordon et al. | |
| 2009/0259082 | A1 | 10/2009 | Deluga et al. | |
| 2010/0089762 | A1 | 4/2010 | Gordon | |
| 2010/0155298 | A1 | 6/2010 | Raterman et al. | |
| 2010/0297531 | A1 | 11/2010 | Liu et al. | |
| 2010/0297537 | A1 | 11/2010 | Coors et al. | |
| 2010/0304953 | A1 | 12/2010 | Liu et al. | |
| 2011/0054232 | A1 | 3/2011 | Sangar et al. | |
| 2011/0100874 | A1 | 5/2011 | Gordon | |
| 2011/0119994 | A1 | 5/2011 | Hogendoorn et al. | |
| 2011/0155647 | A1 | 6/2011 | Serban et al. | |
| 2012/0304530 | A1 | 12/2012 | Chitta et al. | |
| 2013/0043160 | A1 | 2/2013 | Gordon | |
| 2013/0140217 | A1 | 6/2013 | Gordon et al. | |
| 2013/0153469 | A1 | 6/2013 | Gordon | |

OTHER PUBLICATIONS

Lee, Dong W., "Written Opinion of the International Searching Authority", PCT/US2013/023850 (Corresponding to U.S. Appl. No. 13/753,918), (May 14, 2013), 1-5.

Wood, Elizabeth D., "Non-Final Office Action", U.S. Appl. No. 13/497,057, (Jul. 15, 2013), 1-7.

Reggel, et al., "Desulphurization of Gasoline by Metallic Sodium", *Fuel,* vol. 55, (Jul. 1976),170-172.

Byun, Sang H., "International Search Report", International Search Report for PCT US 2010/054984 (Corresponding to U.S. Appl. No. 12/916,984, (Jul. 28, 2011),1-3.

Byun, Sang H., "Written Opinion of the International Searching Authority", Written Opinion for PCT US 2010/054984 (Corresponding to U.S. Appl. No. 12/916,984, (Jul. 28, 2011),1-5.

Kabe, T. et al., "Hydrodesulfurization and Hydrodenitrogenation", *Wiley-VCH* , (1999),110-112.

Task Force on STRAT. UNCNV. Fuel, "America's Strategic Unconventional Fuels, vol. III Resource and Technology Profiles", *America's Strategic Unconventional Fuels, vol. III Resource and Technology Profiles* (completed.Feb. 2007, Published Sep. 2007)., Full text available at http://www.unconventionalfuels.org/publications/reports/Volume_III_ResourceTechProfiles(Final).pdf,(Sep. 2007),III-25.

Lee, Young W., "International Search Report", PCT/US/2012/039388 (corresponding to U.S. Appl. No. 12/916,948), (Dec. 27, 2012),1-3.

Lee, Young W., "Written Opinion of the International Searching Authority", PCT/US/2012/039388 (corresponding to U.S. Appl. No. 12/916,948), (Dec. 27, 2012),1-3.

Hwang, Yun K., "International Search Report", PCT App. No. PCT/US2012/065670 (corresponding to U.S. Appl. No. 13/679,696), (Apr. 1, 2013),1-4.

Hwang, Yun K., "Written Opinion of the International Searching Authority", PCT App. No. PCT/US2012/065670 (corresponding to U.S. Appl. No. 13/679,696), (Apr. 1, 2013),1-8.

Sternberg, et al., "On the Solubilization of Coal Via Reductive Alkylation", *Preprints of Papers—American Chemical Society, Division of Fuel Chemistry* (1970), 14(1), (available to the public 1984), (1984),87-94.

Bentor, Yinon "Chemical Element.com—Sodium", http://www.chemicalelement.com/elements/na.html, (1996),1-3.

Yu, Jianfei et al., "High temperature naphthenic acid corrosion of steel in high TAN refining media", *Anti-Corrosion Methods and Materials,* vol. 55 Issue 5, (2008),257-63.

Wang, Chen et al., "High Temperature Naphthenic Acid Corrosion of Typical Steels", *Canadian Journal on Mechanical Sciences and Engineering* vol. 2, No. 2 (Feb. 1, 2011),23-30.

Seo, Sang Y., "International Search Report", PCT App. No. PCT/US2012/046939 (Corresponding to U.S. Appl. No. 13/550,313), (Jan. 31, 2013),1-3.

Seo, Sang Y., "Written Opinion of the International Searching Authority", PCT App. No. PCT/US2012/046939 (Corresponding to U.S. Appl. No. 13/550,313), (Jan. 31, 2013),1-6.

"Natural Gas", http://www.gasenergia.com.br/portal/ing/gasnatural/dadostecnicos.jsp, (Jun. 10, 2004),1-20.

Sternberg, et al., "Solubilization of Coal via Reductive Alkylation", *Preprints of Papers—American Chemical Society, Division of Fuel Chemistry* (1970), 14(1), 87-94 (available to the public 1984) CODEN: ACFPAI, ISSN: 0569-3772, (1970),87-94.

Lee, Dong W., "International Search Report", PCT Application No. PCT/US1350194 (Corresponding to U.S. Appl. No. 13/940,336), (Nov. 5, 2013),1-5.

Lee, Dong W., "Written Opinion of the International Searching Authority", PCT Application No. PCT/US1350194 (Corresponding to U.S. Appl. No. 13/940,336), (Nov. 5, 2013),1-5.

Lee, Dong W., "International Search Report", PCT Application No. PCT/US2013/026698 (Corresponding to U.S. Appl. No. 13/770,610), (Aug. 19, 2013),1-5.

Lee, Dong W., "Written Opinion of the International Searching Authority", PCT Application No. PCT/US2013/026698 (Corresponding to U.S. Appl. No. 13/770,610), (Aug. 19, 2013),1-5.

* cited by examiner

UPGRADING PLATFORM USING ALKALI METALS

CROSS-REFERENCED RELATED APPLICATIONS

This application claims the benefit of U.S. Provisional Patent Application No. 61/508,415, filed on Jul. 15, 2011. This application is also a continuation-in-part of U.S. patent application Ser. No. 12/916,984 filed on Nov. 1, 2010, which application claims the benefit of U.S. Provisional Patent Application No. 61/257,369, filed on Nov. 2, 2009. These prior patent applications are expressly incorporated herein by reference.

U.S. GOVERNMENT INTEREST

This invention was made with government support under Contract No. DE-FE0000408 awarded by the U.S. Department of Energy. The government has certain rights in the invention.

TECHNICAL FIELD

The present disclosure relates to a process for removing nitrogen, sulfur, and heavy metals from sulfur-, nitrogen-, and metal-bearing shale oil, bitumen, or heavy oil so that these materials may be used as a hydrocarbon fuel.

BACKGROUND

The demand for energy (and the hydrocarbons from which that energy is derived) is continually rising. However, hydrocarbon raw materials used to provide this energy often contain difficult-to-remove sulfur and metals. For example, sulfur can cause air pollution and can poison catalysts designed to remove hydrocarbons and nitrogen oxide from motor vehicle exhaust, necessitating the need for expensive processes used to remove the sulfur from the hydrocarbon raw materials before it is allowed to be used as a fuel. Further, metals (such as heavy metals) are often found in the hydrocarbon raw materials. These heavy metals can poison catalysts that are typically utilized to remove the sulfur from hydrocarbons. To remove these metals, further processing of the hydrocarbons is required, thereby further increasing expenses.

Currently, there is an on-going search for new energy sources in order to reduce the United States' dependence on foreign oil. It has been hypothesized that extensive reserves of shale oil, which constitutes oil retorted from oil shale minerals, will play an increasingly significant role in meeting this country's future energy needs. In the U.S., over 1 trillion barrels of usable, reserve shale oil are found in a relatively small area known as the Green River Formation located in Colorado, Utah, and Wyoming. As the price of crude oil rises, these shale oil resources become more attractive as an alternative energy source. In order to utilize this resource, specific technical issues must be solved in order to allow such shale oil reserves to be used, in a cost effective manner, as hydrocarbon fuel. One issue associated with these materials is that they contain a relatively high level of nitrogen, sulfur and metals, which must be removed in order to allow this shale oil to function properly as a hydrocarbon fuel.

Other examples of potential hydrocarbon fuels that likewise require a removal of sulfur, nitrogen, or heavy metals are bitumen (which exists in ample quantities in Alberta, Canada) and heavy oils (such as are found in Venezuela).

The high level of nitrogen, sulfur, and heavy metals in oil sources such as shale oil, bitumen and heavy oil (which may collectively or individually be referred to as "oil feedstock") makes processing these materials difficult. Typically, these oil feedstock materials are refined to remove the sulfur, nitrogen and heavy metals through processes known as "hydro-treating" or "alkali metal desulfurization."

Hydro-treating may be performed by treating the material with hydrogen gas at elevated temperature and an elevated pressure using catalysts such as Co—Mo/$Al_2O_3$ or Ni—Mo/$Al_2O_3$. Disadvantages of hydro-treating include over saturation of organics where double bonds between carbon atoms are lost and fouling of catalysts by heavy metals which reduces the effectiveness of hydro-treating. Additionally hydro-treating requires hydrogen, which is expensive.

Alkali metal desulfurization is a process where the oil feedstock is mixed with an alkali metal (such as sodium or lithium) and hydrogen gas. This mixture is reacted under pressure (and usually at an elevated temperature). The sulfur and nitrogen atoms are chemically bonded to carbon atoms in the oil feedstocks. At an elevated temperature and elevated pressure, the reaction forces the sulfur and nitrogen heteroatoms to be reduced by the alkali metals into ionic salts (such as $Na_2S$, $Na_3N$, $Li_2S$, etc.). To prevent coking (e.g., a formation of a coal-like product) however, the reaction typically occurs in the presence of hydrogen gas. Of course, hydrogen gas is an expensive reagent.

Another downside to processes requiring hydrogen in oil feedstock upgrading is that the source of hydrogen is typically formed by reacting hydrocarbon molecules with water using a steam methane reforming process which produces carbon dioxide emissions. This production of carbon dioxide during the hydro-treating process is considered problematic by many environmentalists due to rising concern over carbon dioxide emissions and the impact such emissions may have on the environment.

An additional problem in many regions is the scarcity of water resources needed to create the hydrogen. For example, in the region of Western Colorado and Eastern Utah where parts of the Green River Formation of shale oil is located, the climate is arid and the use of water in forming hydrogen gas can be expensive.

Thus, while conventional hydro-treating or alkali metal desulfurization processes are known, they are expensive and require large capitals investments in order to obtain a functioning plant and can have adverse environmental effects. There is a need in the industry for a new process that may be used to remove heteroatoms such as sulfur and nitrogen from oil feedstocks, but that is less expensive and more environmentally friendly than conventional processing methods.

U.S. patent application Ser. No. 12/916,984 provides an approach for removing sulfur and nitrogen heteroatoms (and heavy metals) from shale oil, bitumen, and heavy oil by using a hydrocarbon material, such as methane, in connection with sodium metal. (This prior patent application is published as U.S. Patent Application Publication No. 2011/0100874 and is referred to herein as the "'874 application.") The present disclosure builds upon and modifies the approach of the '874 application. Accordingly, it is presumed that the reader is familiar with the teachings of the '874 application

SUMMARY

The present embodiments include a method of upgrading an oil feedstock. The method comprises obtaining a quantity of the oil feedstock, wherein the oil feedstock comprises carbon and hydrogen content, the oil feedstock further comprising metal, sulfur and/or nitrogen content. The oil feedstock is reacted with a radical capping substance and an alkali metal (such as sodium, lithium, alloys of sodium and lithium, etc.). The alkali metal reacts with the metal, sulfur or nitrogen content to form one or more inorganic products. The radical capping substance reacts with the carbon and hydrogen content to form a hydrocarbon phase. The inorganic products may then be separated from the hydrocarbon phase. This separation may occur in a separator, wherein the inorganic products form a phase that is separable from the hydrocarbon phases. After separation, the alkali metal may be electrochemically regenerated from the inorganic products.

In some embodiments, the oil feedstock comprises one or more of the following: petroleum, heavy oil, extra heavy oil, bitumen, shale oil, natural gas, petroleum gas, methane, methyl mercaptan, hydrogen sulfide, refinery streams such as vacuum gas oil, fluidized catalytic cracker (FCC) feed, dimethyl disulfide, and near product streams (such as diesel). The radical capping substance comprises one or more of the following: methane, ethane, propane, butane, pentane, hexane, heptane, octane, ethene, propene, butane, pentene, hexene, heptene, octene, and isomers of the foregoing, natural gas, shale gas, liquid petroleum gas, ammonia, primary, secondary, and tertiary ammines, thiols, mercaptans, and hydrogen sulfide. In some embodiments, the reaction of the oil feedstock with the alkali metal and the radical capping substance occurs in the temperature range from 98° C.-500° C. The reaction may also occur in a pressure range of 500 psi-3000 psi.

If hydrogen sulfide ($H_2S$) or ammonia ($NH_3$) is used as part of the radical capping substance, then hydrogen may be formed in situ. In other words, the sodium metal (alkali metal) reacts with the sulfur/nitrogen moiety of the $NH_3/H_2S$, leaving hydrogen (e.g., hydrogen gas, hydrogen atoms or hydrogen radicals) to react with the hydrocarbons. Thus, ability to use hydrogen sulfide and/or ammonia in the radical capping substance may provide a significant advantage. For example, some natural gas or shale gas may have quantities of $H_2S$ contained therein. This $H_2S$ does not need to be removed before using this substance as the radical capping substances. Rather, the $H_2S$ in the natural gas/shale gas will react to form hydrogen and this hydrogen in turn reacts with the hydrocarbons, while the $CH_4$ (methane) in the natural gas/shale gas also reacts with the hydrocarbons. Thus, a mixture of hydrocarbon products may be obtained when natural gas containing $H_2S$ is used as the radical capping species. (This formed mixture may be further refined, as desired.)

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
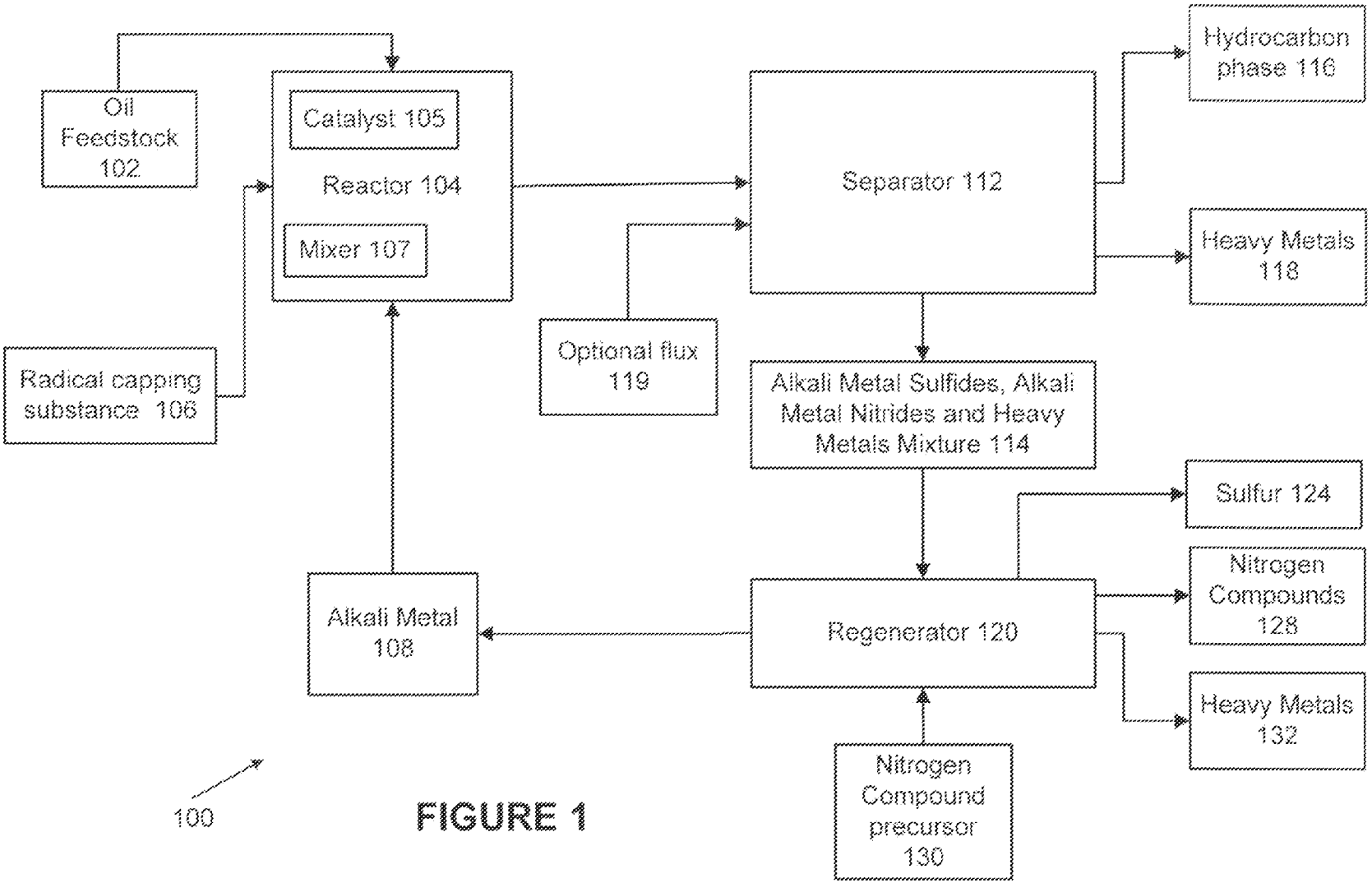
FIG. 1 is flow diagram showing one embodiment of a method of reacting an oil feedstock.

Referring now to FIG. 1, a schematic method 100 of the present embodiments for upgrading an oil feedstock is disclosed. As can be seen from FIG. 1, a quantity of oil feedstock 102 is obtained. This oil feedstock 102 may comprise bitumen, shale oil, heavy oil, or other materials described herein. More specifically, the oil feedstock may include one or more materials from the following group: petroleum, heavy oil, extra heavy oil, bitumen, shale oil, natural gas, petroleum gas, methane, methyl mercaptan, hydrogen sulfide, refinery streams such as vacuum gas oil, fluidized catalytic cracker (FCC) feed, dimethyl disulfide and also near product streams such as diesel which needs extra sulfur removal. The oil feedstock 102 may be obtained via mining or other processes. The oil feedstock 102 is added to a reaction vessel 104 (which is referred to herein as reactor 104). The reactor 104 may include a mixer 107 that is designed to mix (stir) the chemicals added therein in order to facilitate a reaction. A catalyst 105 may also be added to the reactor 104 to foster the reaction. In some embodiments, the catalyst may include (by way of non-limiting example) molybdenum, nickel, cobalt or alloys of molybdenum, alloys of nickel, alloys of cobalt, alloys of molybdenum containing nickel and/or cobalt, alloys of nickel containing cobalt and/or molybdenum, molybdenum oxide, nickel oxide or cobalt oxides and combinations thereof.

Also added to the reactor 104 is a quantity of an alkali metal 108. This alkali metal 108 may be any alkali metal 108 and may include mixtures or alloys of alkali metals 108. In some embodiments, sodium or lithium may be used.

A quantity of a radical capping substance 106 may also be used and added to the reactor 104. As noted above, this radical capping substance 106 may be methane, ethane, propane, etc. or any other hydrocarbon (or even mixtures thereof). However, because of its relative inexpensive nature, natural gas or shale oil gas (which generally contains methane ($CH_4$)) may be used. Other examples of substances that may be used (either alone or in combination) as the radical capping substance include isopropane, butane, pentane, hexane, heptane, octane, ethene, propene, butane, pentene, hexene, heptene, octene, and isomers of the foregoing, natural gas, shale gas (e.g., the gas produced by retorting oil shale), liquid petroleum gas, ammonia, primary, secondary, and tertiary ammines, thiols and mercaptans, and hydrogen sulfide.

As noted herein, the reactor 104 may cause the reaction to occur at a certain temperature or pressure. In some embodiments, the temperature used for the reaction may be elevated up to about 450° C. One exemplary temperature may be 350° C. In some embodiments, temperatures as low as room temperature or ambient temperature may be used. In other embodiments, the temperature may be such that the alkali metal 108 is in a molten state. It will be appreciated by those of skill in the art that sodium becomes molten at about 98° C. whereas lithium becomes molten at about 180° C. Thus, embodiments may be designed in which the temperature of the reactor 104 is between 98° C. and 500° C. The pressure of the reaction may be anywhere from atmospheric pressure and above. Some exemplary embodiments are performed at a pressure that is above about 250 psi. Other embodiment may be performed at a pressure that is below about 2500 psi. In other embodiments, the pressure of the reactor 104 will range from 500 psi to 3000 psi.

When the temperature is elevated, the alkali metal 108 may be molten to facilitate the mixing of this chemical with the other chemicals. However, other embodiments may be designed in which a powdered or other solid quantity of the alkali metal 108 is blown into, or otherwise introduced, into the reactor 104 so that it reacts with the other chemicals.

In a reaction that occurs in the reactor 104, the heteroatoms (such as sulfur and nitrogen) and metals (such as heavy metals) are removed from the oil feedstock 102. The products from the reactor 104 are then sent to a separator 112. The separator 112 may include a variety of devices/processes that are designed to separate the hydrocarbon phase 116 (e.g., the phase that has the hydrocarbons derived from the oil feedstock) from the other reaction products (e.g., inorganic products including the alkali metal, ions, and/or the sulfur/nitrogen/metals). The separator 112 may include filters, centrifuges and the like. The separator 112 may also receive, depending upon the embodiment, an influx of a flux 119. This flux material 119 may be hydrogen sulfide $H_2S$ or water or other chemical(s) that facilitate the separation. Mixing the treated feedstock with hydrogen sulfide to form an alkali hydrosulfide can form a separate phase from the organic phase (oil feedstock). This reaction is shown below, in which sodium (Na) is the alkali metal, although other alkali metals may also be used:

$$Na_2S+H_2S \rightarrow 2NaHS \text{ (which is a liquid at 375° C.)}$$

$$Na_3N+3H_2S \rightarrow 3NaHS+NH_3$$

The nitrogen product is removed in the form of ammonia gas ($NH_3$) which may be vented and recovered, whereas the sulfur product is removed in the form of an alkali hydro sulfide, NaHS, which is separated for further processing. Any heavy metals may also be separated out from the organic hydrocarbons by gravimetric separation techniques.

Some heavy metals 118 which were reduced from the feedstock 102 may separate in the separator and be extracted as heavy metals 118. The separation also produces the organic product, which is the hydrocarbon phase 116. This phase 116 may be sent to a refinery for further processing, as needed, to make this material a suitable hydrocarbon fuel. Another output of the separator 112 is a mixture 114 (stream) of alkali metal sulfides, alkali metal nitrides, and heavy metals 118. This mixture 114 may be further processed as described below. Alternatively or additionally, any nitrogen containing products (such as via ammonia gas ($NH_3$) that is vented off and collected) may also be removed from this stage depending on the type of the process employed.

The mixture 114 of alkali metal sulfides, alkali metal nitrides, and heavy metals 118 may be sent to a regenerator 120. The purpose of the regenerator 120 is to regenerate the alkali metal 108 so that it may be reused in further processing at the reactor 104. Thus, one of the outputs of the regenerator 120 is a quantity of the alkali metal 108. In many embodiments, the regeneration step involves an electrolytic reaction (electrolysis) of an alkali metal sulfide and/or polysulfide using an ionically conductive ceramic membrane (such as, for example, a NaSiCON or LiSiCON membrane that is commercially available from Ceramatec, Inc. of Salt Lake City, Utah). These processes are known and examples of such processes are found in U.S. Pat. No. 3,787,315, U.S. Patent Application Publication No. 2009/0134040 and U.S. Patent Application Publication No. 2005/0161340 (which patent documents are incorporated herein by reference). The result of this electrolysis process is that sulfur 124 will be captured. Further, heavy metals 132 may be separated from the mixture 114, via the electrolysis process or other processes. In further embodiments, the nitrogen containing compounds 128 may also be collected at the regenerator 120. As noted above, such nitrogen compounds 128 may be ammonia gas that is vented off or collected. In other embodiments, nitrogen compound precursors 130 are added to the regenerator 120 to capture/react with the nitrogen containing compounds in the mixture 114 and produce the compounds 128. Those skilled in the art will appreciate the various chemicals and processes that may be used to capture the nitrogen compounds 128 (or to otherwise process the nitrogen obtained from the reaction).

The embodiment of FIG. 1 does not include a Steam-Methane Reforming Process. As noted above, the steam methane reforming process is used to generate the hydrogen and requires inputs of methane and water and outputs hydrogen gas and carbon dioxide. Hydrogen gas is not used in the method 100 (i.e., hydrogen gas is not added to the reactor 104), and as such, there is no need in this method 100 to use a Steam-Methane Reforming Process; however, this method does not preclude the utilization of hydrogen as adjunct reactant to an upgradent hydrocarbon. Thus, carbon dioxide is not produced by the method 100 and water (as a reactant) is not required. As a result, the present method 100 may be less expensive (as it does not require water as a reactant) and may be more environmentally-friendly (as it does not output carbon dioxide into the atmosphere).

The method 100 of FIG. 1 may be run as a batch process or may be a continuous process, depending upon the embodiment. Specifically, if it is a continuous process, the reactants would be continuously added to the reactor 104 and the products continuously removed, separated, etc. Further, the reaction in the reactor 104 may be performed as a single step (e.g., placing all of the chemicals into a single reactor 104) or potentially done as a series of steps or reactions.

In general, the formed inorganic products (e.g., the alkali metal sulfide, alkali metal nitride, and metals) can be separated gravimetrically or by filtration from a lighter (organic) phase bearing the hydrocarbon product. In some cases the product may be comprised of more than one phase. For example the product may be comprised of a gas phase, liquid phase, or gas and liquid phase. There also may be more than one liquid phase where one is lighter than the other.

In one embodiment, natural gas containing $H_2S$ may be used. If the $H_2S$ is in the natural gas, more sodium may be required to obtain the same results since sodium reacts with the $H_2S$ in the natural gas to form hydrogen and sodium sulfide. Thus, $H_2S$ in the presence of sodium can ultimately provide hydrogen that can react with the radicals formed with heteroatom removal. Also, ethene, propene, butane, pentene, hexane, heptene, octane and their isomers may be used.

Other materials that could be used to cap the radical formed from the bond breaking between carbon and sulfur, nitrogen or a metal could include, liquid petroleum gas, ammonia, primary, secondary, and tertiary ammines, thiols and mercaptans. Any molecule that is capable for capping the radical formation may be used as the radical capping substance. It is also understood that when the radical capping substance is a liquid, the pressure at which the process is run may be relatively low (for example at barometric pressure conditions).

The oil feedstocks which may be treated in the manner described herein may also vary. For example feedstock streams where metals, sulfur, and/or nitrogen are bonded to the hydrocarbon (organic) material can be utilized in the process. These streams include petroleum, heavy oil, extra heavy oil, bitumen, shale oil, natural gas, petroleum gas, methane, methyl mercaptan, hydrogen sulfide, refinery streams such as vacuum gas oil, fluidized catalytic cracker (FCC) feed, and also near product streams such as diesel which needs extra sulfur removal and dimethyl disulfide.

As explained herein, the reactions of the present embodiment may be conducted at a temperature above the melting point of the alkali metal which in the case of sodium is above 98° C. However, too high of a temperature, over 500° C., may be undesirable because of vessel corrosion. Also reaction pressures used for the reactions may have a wide range. If the radical capping substance is a liquid, the pressure does not need to be high. If the radical capping substance is a gas then higher pressures (between 500-3000 psi) may be desired to increase the amount of this substance that will intermix with the oil feedstock.

In some embodiments, a preferable temperature for the reaction may be between 350° C. and 450° C. The reactor pressure may be as low as barometric pressure, especially if the feedstock and radical capping substance are liquids at the operating temperature, but if a portion of either component are in the gas phase at the operating temperature, then elevated pressures may be preferred (such as 500-3000 psi). A typical reaction time is 30 minutes to 2 hours. The reactor typically is a pressure vessel comprised of high temperature corrosion resistant materials. Outputs from the reaction may include multiple phases which may be separated in a separator. The reactor output may have a salt phase (inorganic phase) which in general has higher specific gravity than the product phases (hydrocarbon phases). The salt phase in part is comprised of alkali metal salts, sulfide salts, nitride salts and metals. The product phase may be comprised of organic liquid and gas phases. The separator may be comprised of cyclones or columns to promote gravimetric separation, and filter system apparatus to promote solid fluid separation.

The salt phase may be fed to an electrolysis cell. Typically the salts will be fed to the anode side of the cell which may be separated from the cathode side of the cell by an alkali metal ion conductive separator. NaSICON is particularly suitable as the alkali metal ion conductive separator for operation of the cell near 130° C. NaSICON is used where the sodium is molten. Also, if NaSICON is used, cell materials do not need to be exotic. The alkali metal, such as sodium, is regenerated at the cathode and is made available to recycle back to the reactor. The anolyte may be fed or circulated through a separator where solids such as sulfur and metals and gases such as ammonia are removed from the liquid anolyte. Those skilled in the art will appreciate other chemicals/techniques that may be used in order to regenerate the alkali metal and/or separate the inorganic materials from the hydrocarbon/organic products.

Figure 2:
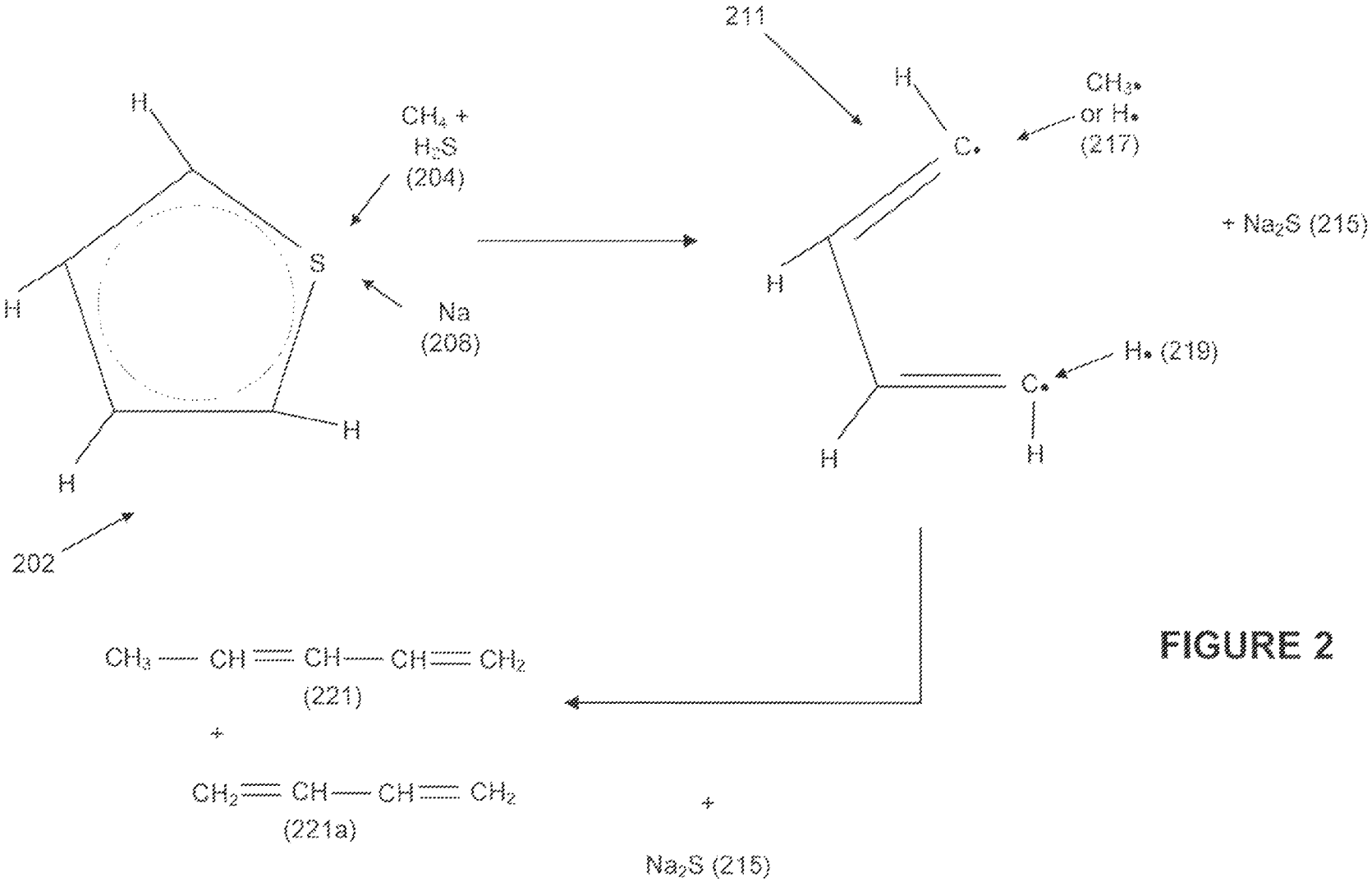
FIG. 2 illustrates a diagram of one embodiment of a chemical reaction used to react with an oil feedstock material.

Referring now to FIG. 2, an example will be provided of the reaction that occurs within the reactor 104 of FIG. 1. In this example, the radical capping species is natural gas 206 extracted from the ground, which contains both methane ($CH_4$) and hydrogen sulfide ($H_2S$). In the embodiment of FIG. 2, the alkali metal is sodium. Further, as an example, the oil feedstock material comprises a thiophene derived product ($C_4H_4S$) 202, which is a cyclic compound that contains sulfur. One purpose of the reactions in the reactor 104 is to upgrade this $C_4H_4S$ material into a product that does not contain sulfur and is better suited for use as a hydrocarbon fuel. Another purpose of the reactions in the reactor 104 is to increase the ratio of hydrogen to carbon of the resulting organic product (thereby giving the product a greater energy value.)

When the $C_4H_4S$ material 202 is reacted, the sodium metal 208 reacts and extracts the sulfur atom, thereby creating a $Na_2S$ product 215. This extraction of the sulfur atom creates an organic intermediate 211 which has the formula ●CHCH-CHCH● and is a radical species (having radicals on either end of the molecule).

At the same time, the sodium reacts with the $H_2S$ (in the natural gas) according the following reaction:

$$2Na+2H_2S \rightarrow 2NaHS \text{ (which is a liquid at 375° C.)} + H_2$$

This radical intermediate 211 then reacts with radical species formed from the methane 206 or hydrogen gas. Specifically, a $CH_3$● radical 217 reacts with one end of the radical intermediate 211 and an H● radical 219 reacts with the other end of the radical intermediate 211, thereby forming an organic product 221 which, in this case, is an alkene ($C_5H_8$). Alternatively, two H● radical 219 (such as, for example, formed from the $H_2$ gas that was created by the $H_2S$) react with either end of the radical intermediate 211, thereby creating a $C_4H_6$ product 221*a*. (Of course, the $Na_2S$ product 215 is also formed and may be separated out from the desired organic products 221*a*, 221.) The mechanism described above is provided for exemplary purposes and does not preclude the possibility of likelihood of alternative mechanisms, pathways and ultimate products formed. This mixture of hydrocarbon phase products 221, 221*a*, may be separated into the hydrocarbon phase and may be further refined, as desired, in order to obtain a usable hydrocarbon product.

It should be noted that the embodiment of FIG. 2 has significant advantages over a method that uses hydro-treating as a mechanism for upgrading the hydrocarbon. For example, if the same oil feedstock shown in FIG. 2 ($C_4H_4S$) 202 was used with hydrogen in a hydro-treating process (as described above), the chemical reaction of this process would be likely would require first saturation of the ring with hydrogen before reaction with the sulfur would occur resulting in higher utilization of hydrogen with the following outcome:

$$C_4H_4S+4H_2 \rightarrow H_2S+C_4H_{10} \text{ (butane)}$$

Alternatively, in the case of standard sodium desulfurization with hydrogen, the chemical reaction of this process would not require saturation of the ring with hydrogen before the reaction with the sulfur, resulting in lower utilization of hydrogen with the following outcome:

$$C_4H_4S+2Na+H_2 \rightarrow Na_2S+C_4H_8$$

A Stream Methane Reforming process may be used to generate the hydrogen gas used in this hydro-treating reaction. Starting with thiophene, using hydrotreating, butane may be formed with a low value heat of combustion of 2654 KJ/mol but where 1.43 moles of methane were used to generate the hydrogen, where the low value heat of combustion equivalent of the methane is 1144 KJ/mol for a net of 1510 KJ/mol, and where 1.43 moles $CO_2$ where emitted generating the hydrogen and 2.86 moles water consumed. Starting with the same thiophene, using the sodium desulfurization process with hydrogen, 1,3 butadiene may be generated with a low value heat of combustion of 2500 KJ/mol but where only 0.36 moles of methane were used to generate the hydrogen, where the low value heat of combustion equivalent of the methane is 286 KJ/mol for a net of 2214 KJ/mol, and where only 0.36 moles $CO_2$ where emitted generating the hydrogen and 0.72 moles water consumed. But with the present invention, starting with the same thiophene, using the sodium desulfurization process with methane for example instead of hydrogen, 1,3 pentadiene may be generated with a low value heat of combustion of 3104 KJ/mol, where only 1 mole of methane was used in the process, where the low value heat of combustion equivalent of the methane is 801 KJ/mol for a net of 2303 KJ/mol, and where no $CO_2$ is emitted or water consumed generating hydrogen. This last case which is the method disclosed in this invention results in 4% higher net energy value while at the same time reduces harmful emissions and reduces water utilization.

In an alternative case, the hydrogen for the hydro-treating process may be supplied by electrolysis of water (as describe above). Assuming that the electrolysis process is 90% efficient and the upgrading process is 100% efficient, the outcome of upgrading thiophene to an upgraded oil product (butane ($C_4H_{10}$)) having a combustion energy equivalent of 2654 kJ/mole. However, the electrical energy required for the electrolysis process to form the hydrogen (assuming no losses in generation or transmission) is 1200 kJ/mole of thiophene. Thus, the net combustion value of upgrading thiophene using hydrogen from electrolysis is 1454 kJ/mole (e.g., 2654-1200). At the same time, four moles of water were consumed per mole of thiophene in making this product. Alternatively, using standard sodium desulfurization with hydrogen generated by electrolysis, to form $C_4H_8$ having a combustion energy equivalent of 2500 kJ/mole. However, the electrical energy required for the electrolysis process to form the hydrogen (assuming no losses in generation or transmission) is 300 kJ/mole of thiophene. Thus, the net combustion value of upgrading thiophene using hydrogen from electrolysis is 2200 kJ/mole (e.g., 2500-300). At the same time, one mole of water was consumed per mole of thiophene in making this product.

However, the process of FIG. 2, which upgrades the $C_4H_8S$ with methane rather than $H_2$, produces a pentadiene ($C_5H_{10}$) product and is more efficient. 1,3 Pentadiene has a combustion energy equivalent of 3104 kcal/mole (which is much higher than 1,3 butadiene). The combustion value of the methane that was consumed in the reaction of FIG. 2 was 801 kJ/mol. The net combustion value for the feedstock produced in FIG. 2 was 2303 kcal/mol (e.g., 3104-801). Again, the net combustion value for the production of 1,3 butadiene via hydrogen from a steam methane reforming process was 2214 kJ/mole, and the embodiment of FIG. 2 provides an additional 89 kJ of energy per mole oil feedstock (e.g., 2303-2214) when the hydrogen is produced from steam methane reforming. This is about a 4.0% increase in net energy, while at the same time using less water resources and emitting no carbon dioxide into the environment. If the hydrogen for the sodium desulfurization process was produced via electrolysis, the increase of the net combustion value for the oil feedstock is 103 kJ of energy per mole oil feedstock (e.g., 2303-2200). This is about a 4.7% increase in net energy, without consuming the water resources in the reaction. Thus, it is apparent that the present embodiments result in an upgraded oil feedstock that has a greater net energy value while at the same time using less water and not emitting carbon dioxide into the environment. Clearly, this is a significant advantage over hydro-treating or the prior art sodium desulfurization with hydrogen regardless of whether the hydrogen is produced by electrolysis or steam methane reforming.

Figure 3:
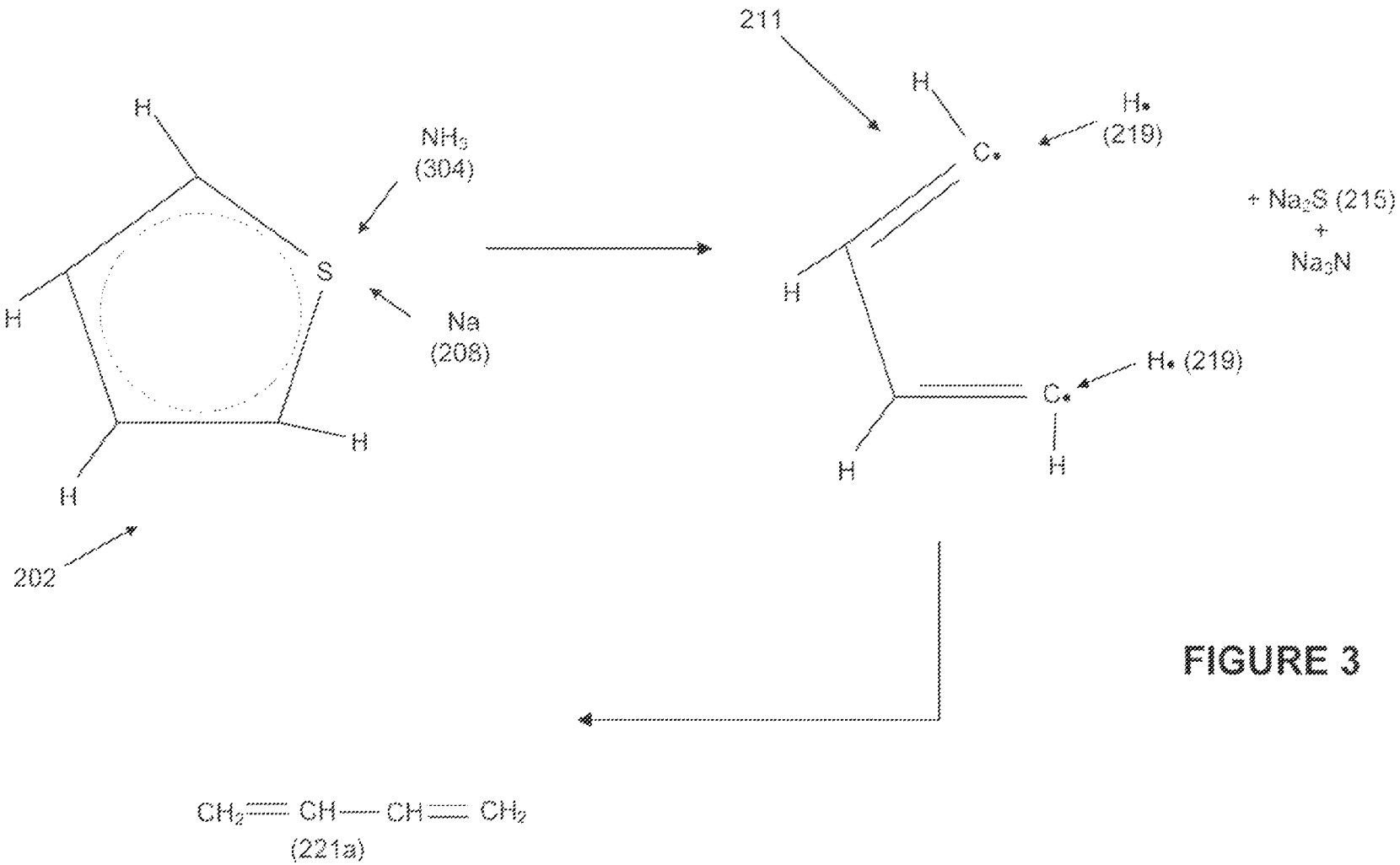
FIG. 3 illustrates a diagram of another embodiment of a chemical reaction used to react with an oil feedstock material.

Referring now to FIG. 3, another example is shown in which the radical capping species is ammonia ($NH_3$) 304. The oil feedstock material comprises a thiophene derived product ($C_4H_4S$) 202, which is a cyclic compound that contains sulfur. As noted herein, when reacted with sodium metal 208, the sulfur is removed from the organic material 202, thereby forming an organic radical species 211. Sodium sulfide 215 is also formed. At the same time, the sodium metal also reacts with the ammonia to form sodium nitride ($Na_3N$) and hydrogen. These hydrogen moieties (whether in the form of H radicals or $H_2$ gas) may then react with the organic radical species 211. (In FIG. 3, the hydrogen moieties are shown as H radicals 219.) This reaction with the organic radical species 211 forms an organic product 221*a* that may be used as a fuel. In the case of FIG. 3, the organic product 221*a* is $C_4H_6$.

In some embodiments the API gravity of the resulting hydrocarbon that is produced after the reaction is increased with respect to the API gravity of the starting material. This increase in API gravity suggests that the resulting product in more suitable as a hydrocarbon fuel than the starting material.

EXAMPLES

Example 1

Several laboratory tests were conducted where approximately 180 grams of oil produced from retorted Jordanian oil shale was heated to about 300° C. with either a cover gas of hydrogen or methane in a Parr 500 cubic centimeter autoclave with a gas induction impeller. With each run, varying amounts of sodium were added. After the sodium addition the temperature was raised to 380° C. and pressure was raised to about 1500 psig (pounds per square inch gauge). Two hours after the sodium addition the autoclave was quenched. Gases where measured and analyzed and the liquids were separated from the solids and analyzed for chemical composition and API gravity.

Figure 4:
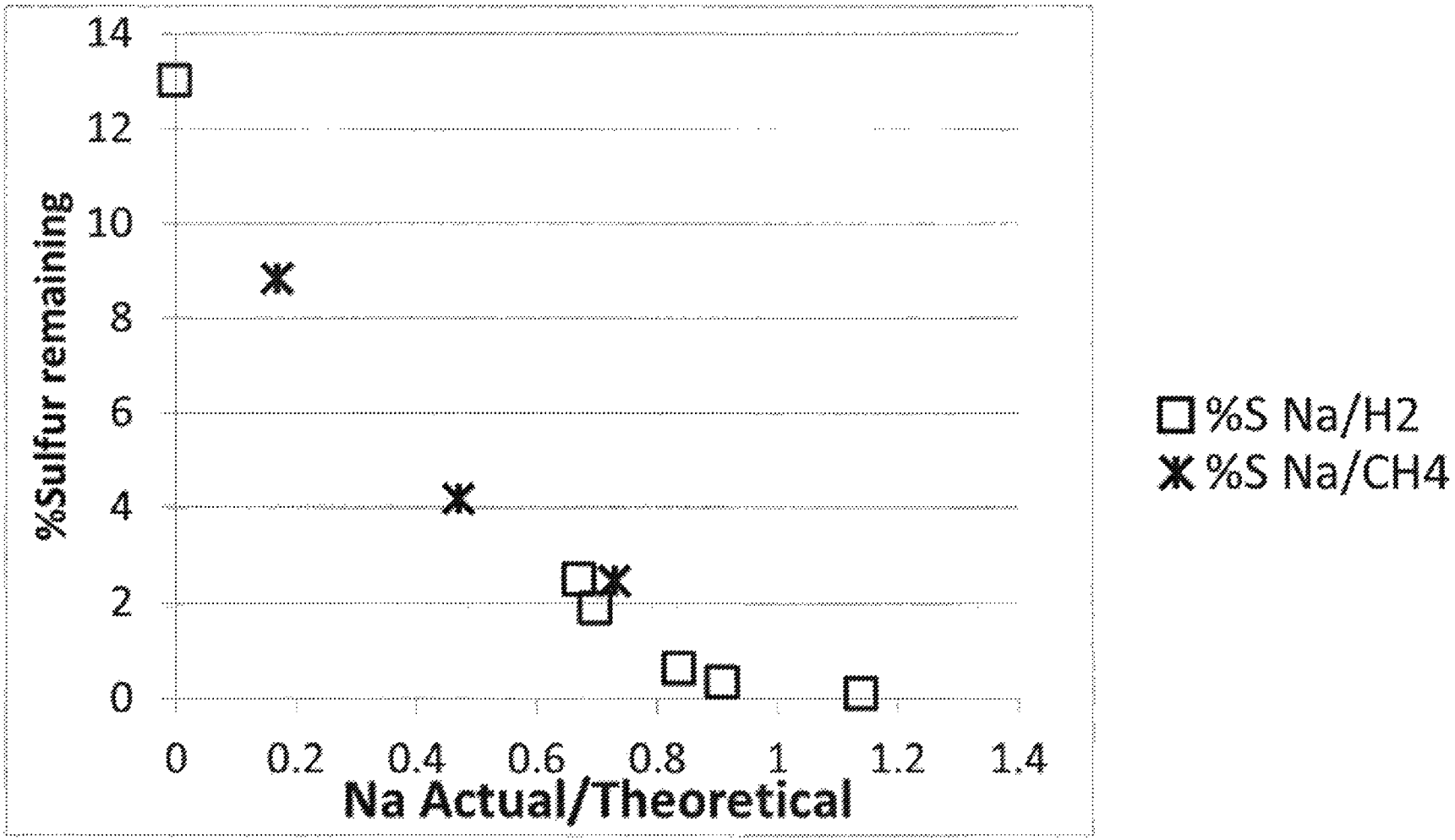
FIG. 4 illustrates a graph of sulfur content versus sodium addition for Jordanian Oil retorted from Oil Shale.

FIG. 4 shows a plot of the sulfur content in the liquid oil product for the numerous runs where the amount of sodium added is expressed as the actual amount added divided by the theoretical amount needed based on the sulfur and nitrogen content, assuming 2 moles of sodium for every mole of sulfur and 3 moles of sodium for every mole of nitrogen.

Figure 5:
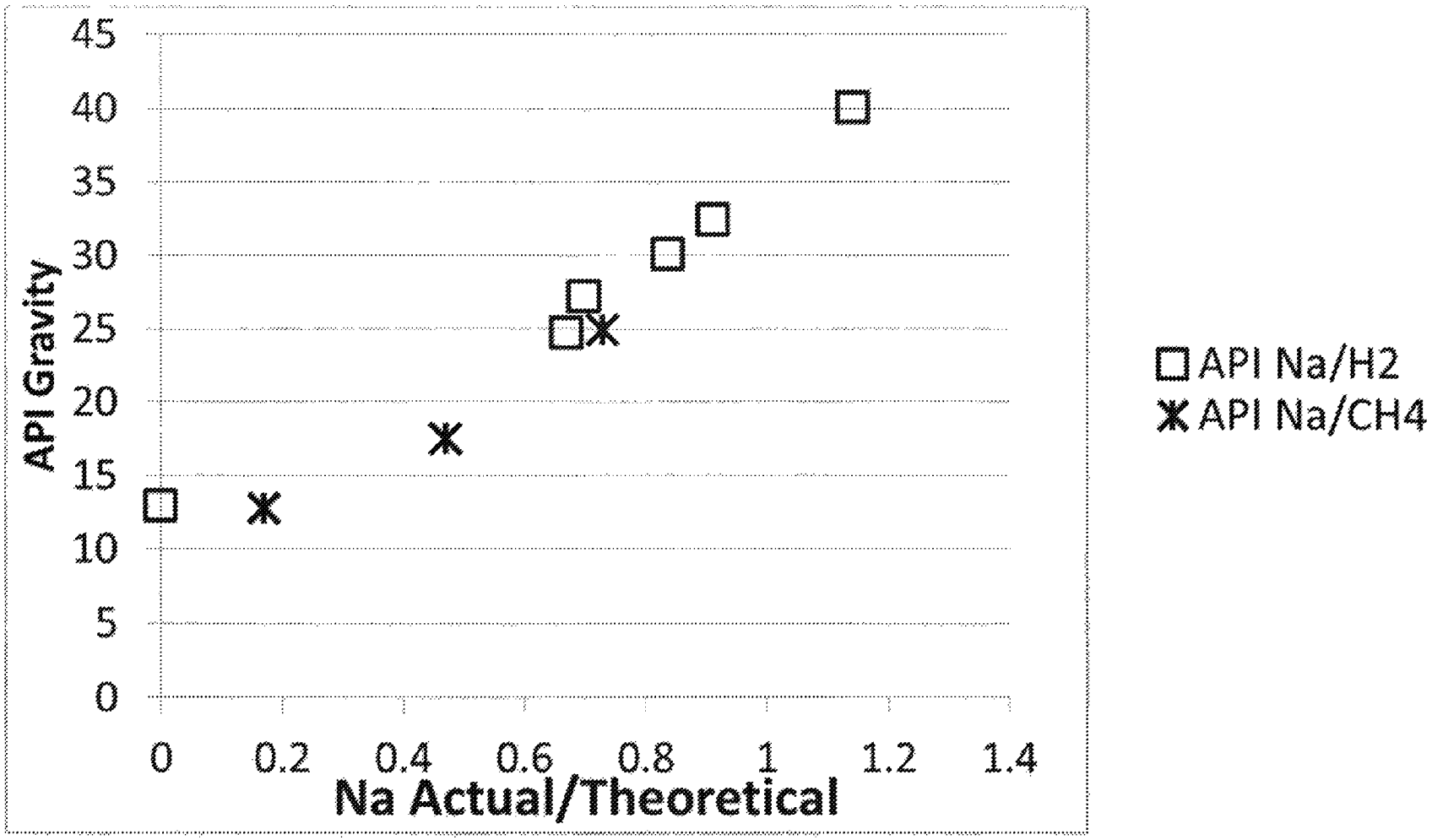
FIG. 5 illustrates a graph of API gravity versus sodium addition for Jordanian Oil retorted from Oil Shale.

FIG. 5 shows a plot of the API gravity in the liquid oil product for the numerous runs where the amount of sodium added is expressed as the actual amount added divided by the theoretical amount needed based on the sulfur and nitrogen content, assuming 2 moles of sodium for every mole of sulfur and 3 moles of sodium for every mole of nitrogen. The general trend shows rising API gravity as the amount of sodium is increased with similar results both with hydrogen and methane as the cover gas.

Example 2

Several laboratory tests were conducted where approximately 180 grams of Athabasca bitumen from Alberta, Canada, diluted with condensate from natural gas production was processed in the same way as example 1.

Figure 6:
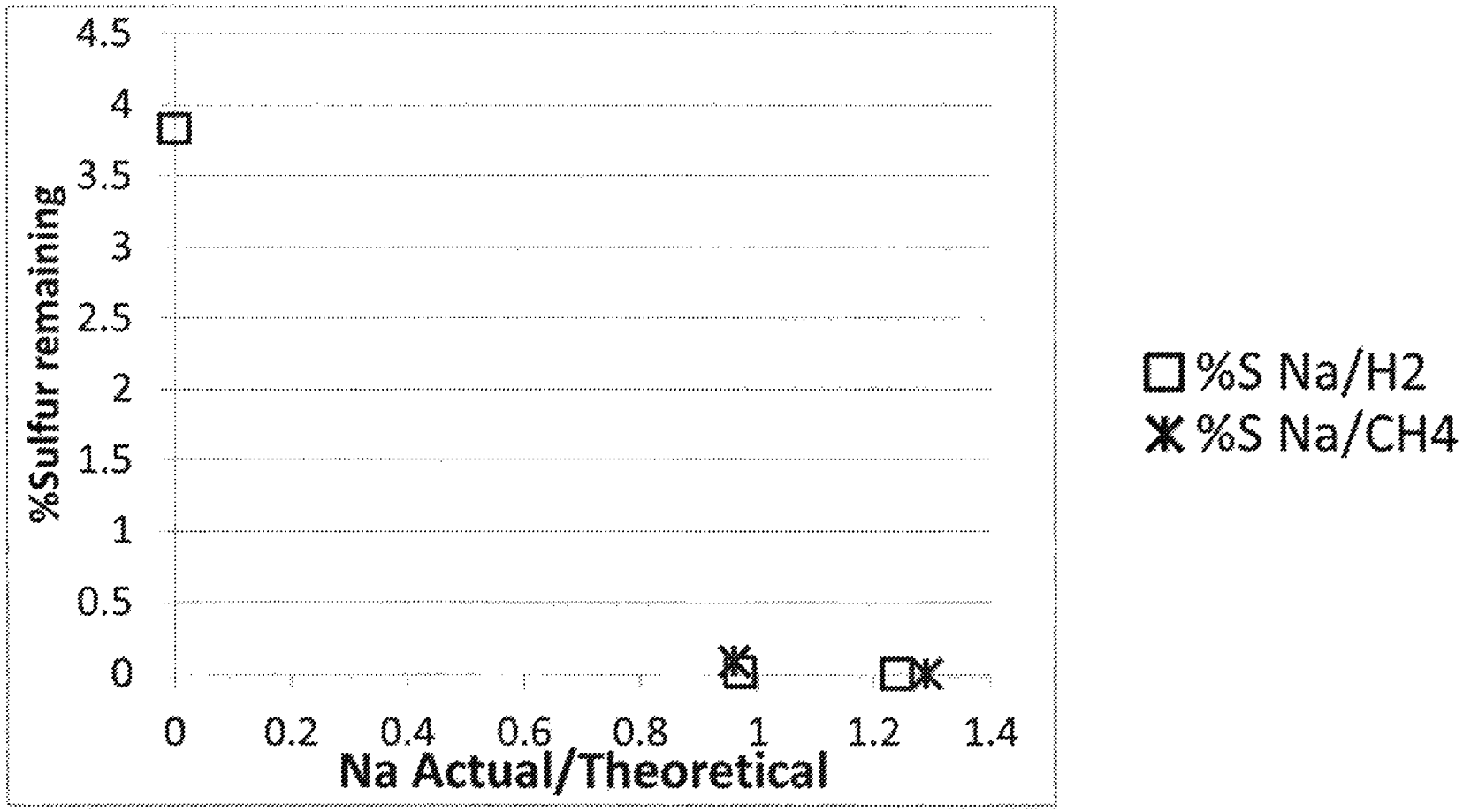
FIG. 6 illustrates a graph of sulfur content versus sodium addition for diluted Athabasca bitumen from Alberta, Canada.

FIG. 6 shows a plot of the sulfur content in the liquid oil product for the numerous runs where the amount of sodium added is expressed as the actual amount added divided by the theoretical amount needed based on the sulfur and nitrogen content, assuming 2 moles of sodium for every mole of sulfur and 3 moles of sodium for every mole of nitrogen.

FIG. 6 shows the general trend where the more sodium added results in less sulfur content in the product oil. The figure also shows the results are nearly the same whether hydrogen or methane are utilized as the cover gas.

Example 3

Several laboratory tests were conducted where approximately 180 grams of oil retorted from Uinta Basin oil shale in Utah, USA, was processed in the same way as example 1.

Figure 7:
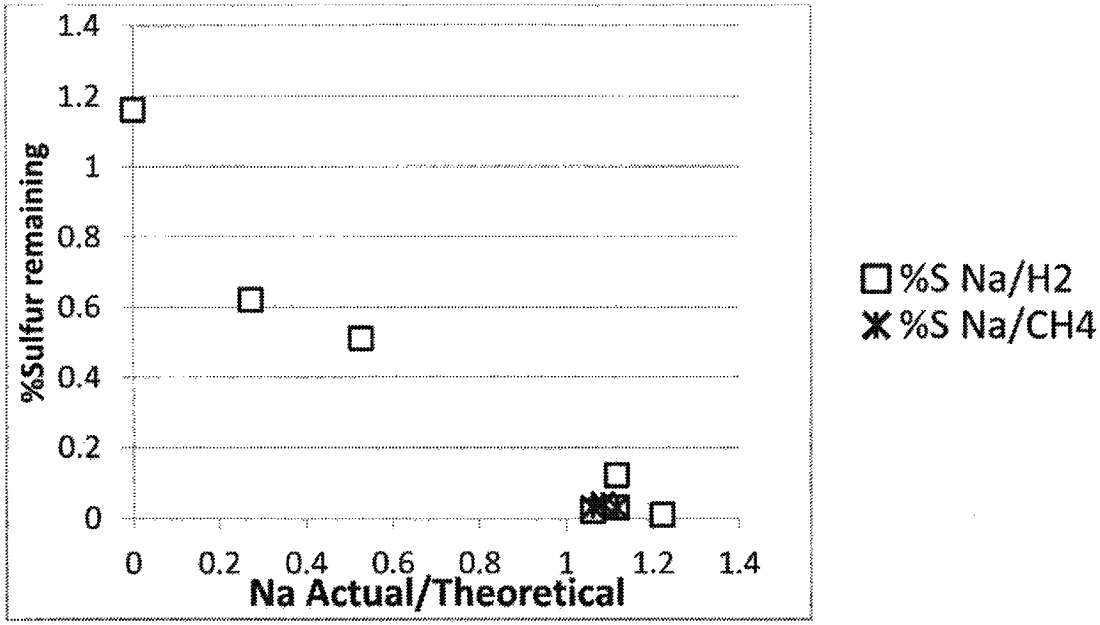
FIG. 7 illustrates a graph of sulfur content versus sodium addition for Uinta Basin oil retorted from oil shale.

FIG. 7 shows a plot of the sulfur content in the liquid oil product for the numerous runs where the amount of sodium added is expressed as the actual amount added divided by the theoretical amount needed based on the sulfur and nitrogen content, assuming 2 moles of sodium for every mole of sulfur and 3 moles of sodium for every mole of nitrogen.

FIG. 7 shows the general trend where the more sodium added results in less sulfur content in the product oil. The figure also shows the results are nearly the same whether hydrogen or methane are utilized as the cover gas.

Example 4

A feedstock oil was derived (extracted) from the Uintah Basin in Eastern Utah, USA. This oil feedstock comprised shale oil containing sulfur and nitrogen. This oil feedstock was centrifuged to remove any solids found therein. The centrifuged oil feedstock had the following composition:

| % Carbon in Shale Oil | % Hydrogen in Shale Oil | % Nitrogen in Shale Oil | % Sulfur in Shale Oil | Hydrogen-to-Carbon Ratio | Nitrogen-to-Carbon Ratio | Sulfur-to-Carbon Ratio |
|---|---|---|---|---|---|---|
| 84.48 | 12.33 | 1.48 | 0.25 | 0.146 | 0.0175 | 0.0030 |

179.2 grams of the centrifuged shale oil was combined with 6 grams of sodium metal in a reactor vessel. The shale oil was blanketed with methane gas to 113 pounds per square inch absolute pressure (7.68 atmospheres) and then heated to 150° C. Once at 150° C., the pressure of the vessel was increased to 528 pounds per square inch absolute pressure (35.9 atmospheres) for 1 hour. After 1 hour, the heat source was removed from the reactor vessel and the vessel was cooled to room temperature. After cooling, the pressure in the vessel was released.

The reacted mixture included a liquid phase and a solid phase. The liquid phase was separated from the solid phase by centrifugation. The resulting reacted oil had the following composition in terms of Carbon, Hydrogen, Nitrogen and Sulfur and composition:

| % Carbon in Product | % Hydrogen in Product | % Nitrogen in Product | % Sulfur in Product | Hydrogen-to-Carbon Ratio in Product | Nitrogen-to-Carbon ratio in Product | Sulfur-to-Carbon Ratio in Product |
|---|---|---|---|---|---|---|
| 85.04 | 12.83 | 0.68 | 0.15 | 0.151 | 0.0080 | 0.0018 |

As can be seen from this example, the reaction with methane lowered the amount of nitrogen in the product. Thus, the ratio of nitrogen to carbon in the end product is much less than it was in the original shale oil. In fact, the reduction in the nitrogen-to-carbon ratio was about 54.4%. Similarly, the amount of sulfur in the end product is much less after the reaction with methane. Accordingly, the ratio of sulfur to carbon in the end product is much less than it was in the original shale oil. The reduction in the sulfur-to-carbon ratio was about 40.4%. Further, the percentage of hydrogen in the end product is greater than it was in the unreacted shale oil and thus, the hydrogen-to-carbon ratio of the end product has also increased.

In addition to the reduction in nitrogen and sulfur content, the American Petroleum Institute gravity ("API gravity") of the original shale oil was 35.29. (API gravity is a measure of how heavy or light a petroleum liquid is compared to water. If its API gravity is greater than 10, it is lighter than water and floats on water, whereas if the API gravity is less than 10, it is heavier and sinks in water. API gravity is an inverse measure of the relative density of the petroleum liquid and is used to compare the relative densities of petroleum liquids.) After the reaction, however, the API gravity increased to 39.58. This increase in the API gravity indicates an upgrading of the shale oil after the reaction.

Figure 8:
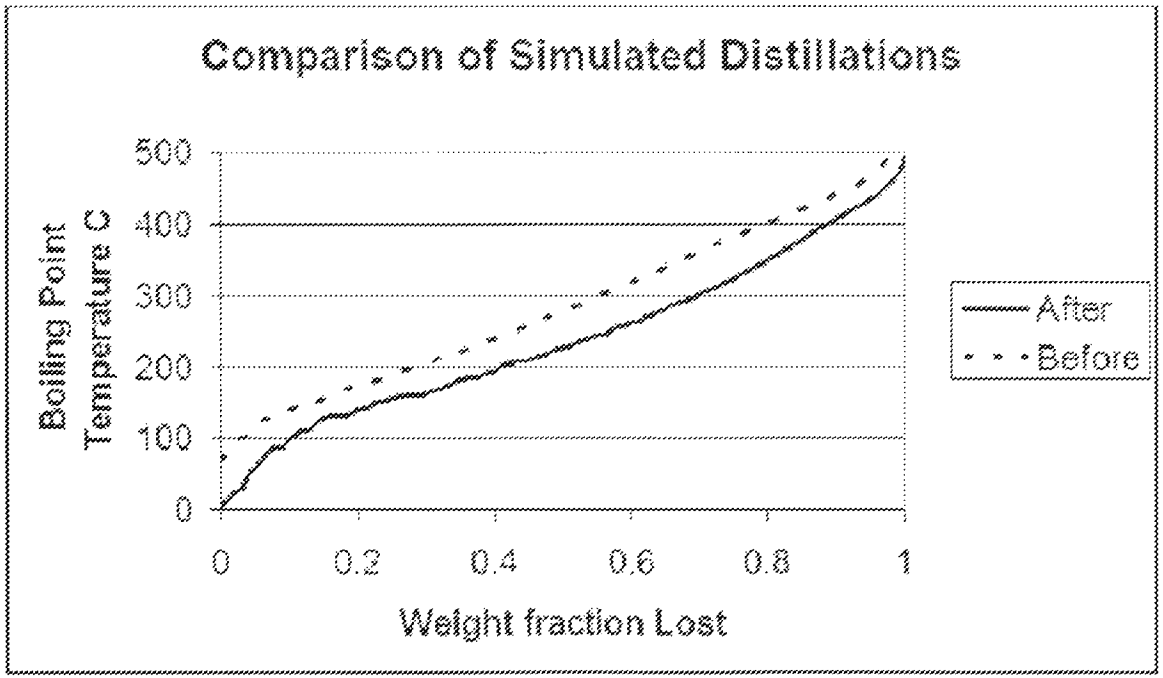
FIG. 8 shows a plot of Boiling Point temperatures versus Weight Fraction Lost of an example of shale oil before and after the reaction described in the present embodiments.

The oil produced from the above-described reaction was also analyzed by a gas chromatograph and a simulated distillation was determined. FIG. 8 shows a plot of Boiling Point temperatures versus Weight Fraction Lost of the oil before and after the reaction. The average difference in Boiling Point before and after the treatment was 45.7° C. This decrease in the simulated boiling point temperature also indicates an upgrading of the shale oil after the reaction.

The reduction in nitrogen and sulfur content, the increase in API gravity, and the decrease in boiling point temperature are all indications of an upgrading of the oil without using a conventional hydro-treating process.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method of upgrading an oil feedstock comprising:

obtaining a quantity of the oil feedstock, wherein the oil feedstock comprises carbon and hydrogen content, the oil feedstock further comprising metal, sulfur and/or nitrogen content;

reacting the quantity of the oil feedstock with an alkali metal and a radical capping substance, wherein the alkali metal reacts with the metal, sulfur or nitrogen content to form one or more inorganic products, wherein the radical capping substance reacts with the carbon and hydrogen content to form a hydrocarbon phase; and separating the inorganic products from the hydrocarbon phase.

2. The method of claim 1, wherein the oil feedstock comprises one or more of the following: petroleum, heavy oil, extra heavy oil, bitumen, shale oil, natural gas, petroleum gas, methane, methyl mercaptan, hydrogen sulfide, refinery streams, vacuum gas oil, fluidized catalytic cracker (FCC) feed, dimethyl disulfide, and near product streams.

3. The method of claim 1, wherein the radical capping substance comprises one or more of the following: methane, ethane, propane, butane, pentane, hexane, heptane, octane, ethene, propene, butane, pentene, hexene, heptene, octene, and isomers of the foregoing, natural gas, shale gas, liquid petroleum gas, ammonia, primary, secondary, and tertiary ammines, thiols, mercaptans, and hydrogen sulfide.

4. The method of claim 1, wherein the reacting the quantity of the oil feedstock with the alkali metal and the radical capping substance occurs in the temperature range from 98° C.-500° C.

5. The method of claim 1, wherein the reacting the quantity of the oil feedstock with the alkali metal and the radical capping substance occurs in the pressure range of 500 psi-3000 psi.

6. The method of claim 1, further comprising:

electrochemically regenerating the alkali metal from the inorganic products.

7. The method of claim 1, wherein the separating occurs in a separator, wherein the inorganic products form a phase that is separable from the hydrocarbon phases.

8. The method of claim 1, wherein the reacting the quantity of the oil feedstock with an alkali metal and a radical capping substance forms hydrogen in situ.

9. The method of claim 8, wherein the radical capping substance comprises natural gas containing quantities of $H_2S$.

10. The method of claim 1, wherein the API gravity of the hydrocarbon phase is greater than the API gravity of the oil feedstock.

11. The method as in claim 1, wherein hydrocarbon phase has a greater energy value than the oil feedstock.

* * * * *